US006269236B1

(12) United States Patent
Mori et al.

(10) Patent No.: US 6,269,236 B1
(45) Date of Patent: Jul. 31, 2001

(54) CLEANING DEVICE FOR A PHOTOSENSITIVE ELEMENT

(75) Inventors: Yukihiro Mori, Shijonawate; Shinichi Higo, Kogoshima-ken, both of (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/479,677

(22) Filed: Jan. 7, 2000

(30) Foreign Application Priority Data

Jan. 18, 1999 (JP) ..... 11-009733

(51) Int. Cl.[7] ..... G03G 21/00
(52) U.S. Cl. ..... 399/354; 399/349
(58) Field of Search ..... 399/353, 354, 399/349

(56) References Cited

U.S. PATENT DOCUMENTS

| | | | | |
|---|---|---|---|---|
| 4,134,673 | * | 1/1979 | Fisher | 399/353 |
| 4,319,831 | * | 3/1982 | Matsui et al. | 399/353 |
| 4,640,599 | * | 2/1987 | Doutney | 399/354 X |
| 4,660,962 | * | 4/1987 | Maekawa et al. | 399/354 |
| 4,835,807 | * | 6/1989 | Swift | 399/353 X |
| 4,870,466 | * | 9/1989 | Iida | 399/354 X |
| 5,124,757 | * | 6/1992 | Ikegawa | 399/354 X |
| 5,689,791 | * | 11/1997 | Swift | 399/353 |
| 6,009,301 | * | 12/1999 | Maher et al. | 399/353 |

FOREIGN PATENT DOCUMENTS

| | | |
|---|---|---|
| 58-38168 | 4/1983 | (JP) . |
| 62-239183 | 10/1987 | (JP) . |
| 63-27874 | 2/1988 | (JP) . |
| 2-138772 | 11/1990 | (JP) . |
| 4-29284 | 1/1992 | (JP) . |
| 4-142566 | 5/1992 | (JP) . |
| 9-90840 | 4/1997 | (JP) . |
| 9-179466 | 7/1997 | (JP) . |
| 10-63162 | 3/1998 | (JP) . |

* cited by examiner

*Primary Examiner*—Fred L Braun
(74) *Attorney, Agent, or Firm*—Jordan and Hamburg LLP

(57) ABSTRACT

A cleaning device removes residual toner on the outer surface of a photosensitive element by bringing a brush into contact with the outer surface of the photosensitive element after an electrostatic latent image on the outer surface of the photosensitive element is developed into a toner image by the reversed development method. The electric resistance value between the brush and photosensitive is in the range of $10^3$ to $10^8$ Ωcm, and the density thereof is in the range of 30000 to 100000 bristles/(inch)$^2$. A DC voltage having a polarity opposite from the charging polarity of the toner and being in the range of 100 to 300 V in absolute value is applied to the brush after an AC voltage having a frequency of 100 to 2000 Hz and an interpeak voltage of 400 to 700 V is superimposed thereon. Further, the brush is rotated in a direction opposite from the rotating direction of the photosensitive element in its portion held in contact with the photosensitive element. Accordingly, the cleaning device can suppress the adhesion of the toner to the outer surface of the photosensitive element by fusion and the scraping of the photosensitive element while maintaining a satisfactory cleaning performance.

9 Claims, 2 Drawing Sheets

CLEANING DEVICE FOR A PHOTOSENSITIVE ELEMENT

The present invention relates to a brush cleaning device in a copier, a facsimile, a printer or like image forming apparatus of reversed development type and more particularly to a brush-cleaning device in an image forming apparatus of reversed development type which cleaning device suppresses the adhesion of toner to the outer surface of a photosensitive element by fusion and the scraping of the photosensitive element while maintaining a satisfactory cleaning performance.

BACKGROUND OF THE INVENTION AND RELATED ART STATEMENTS

Toner attached to an image (electrostatic latent image) formed on a photosensitive element to develop the image is electrostatically transferred to a transfer material such as paper by a transfer step. However, about several to 20% of the toner attached to the photosensitive element remains on the photosensitive element without being completely be transferred. If the residual toner on the outer surface of the photosensitive element is carried to the next developing step, a charging device cannot sufficiently charge the photosensitive element since a portion of the outer surface of the photosensitive element where the toner remains is blocked by the toner. Accordingly, an image formed next becomes defective. Besides the toner, if paper powder or the like is carried to the next developing step without being cleaned, it may enter the developing device in a developing area to cause an imaging failure, a developing device trouble or other problem.

Accordingly, in conventional image forming apparatuses, a cleaning device is provided to remove the toner and other materials residual on the photosensitive element. A variety of cleaning methods including magnetic brush-cleaning, electrostatic brush-cleaning, brush-cleaning, magnetic roller-cleaning, blade-cleaning have been proposed as cleaning methods. Among these methods, the brush-cleaning and blade-cleaning are generally used in combination since they provide a satisfactory cleaning performance.

However, the use of the brush-cleaning and blade-cleaning in combination causes an image degradation since the outer surface of the photosensitive element is scraped by a cleaning blade held in strong sliding contact with the outer surface of the photosensitive element. Further, a frictional heat is produced in a position where the cleaning blade is in contact with the photosensitive element and fuses the residual toner to adhere to the outer surface of the photosensitive element, thereby causing so-called "black dots" in a final image.

In view of the above problem, an object of the present invention is to provide a cleaning device which suppresses the adhesion of toner to the outer surface of the photosensitive element by fusion and the scraping of the photosensitive element while maintaining a satisfactory cleaning performance.

SUMMARY OF THE INVENTION

In order to accomplish the above object, the invention is directed to a cleaning device for removing toner residual on the outer surface of a photosensitive element after an electrostatic latent image on the outer surface of the photosensitive element is developed with toner into a toner image by the reversed development method and the toner image is transferred to a transfer material, comprising a photosensitive element having a shaft with an axis of rotation and a brush to be held in contact with the outer surface of the photosensitive element to remove the residual toner said brush having a shaft defining an axis of rotation, wherein the resistance value between the shaft of the brush and the shaft of the photosensitive element is in the range of $10^3$ to $10^8$ Ωcm; the density thereof is in the range of 30,000 to 100,000 bristlesl(inch)$^2$; a DC voltage having a polarity opposite from the charging polarity of the toner and being in the range of 100 to 300 V in absolute value is applied to the brush after an AC voltage having a frequency of 100 to 2000 Hz and an interpeak voltage of 400 to 700 V is superimposed thereon; and the brush is rotated in a direction opposite from the rotating direction of the photosensitive element in its portion held in contact with the photosensitive element.

With the above construction, the toner residual on the outer surface of the photosensitive element is removed by the rotation of the brush, and the adhesion of the toner to the outer surface of the photosensitive element by fusion and the scraping of the photosensitive element can be suppressed while a satisfactory cleaning performance is maintained.

Preferably, a biting degree of the brush into the photosensitive element is set in the range of 0.9 to 1.9 mm. With this arrangement, a satisfactory cleaning performance can be maintained and the durability of the brush can be improved.

Preferably, the leading ends of bristles of the brush are rounded. This arrangement suppresses the scraping of the photosensitive element.

These and other objects, features and advantages of the present invention will become apparent upon reading the following detailed description along with accompanying drawings.

DETAILED DESCRIPTION OF THE PREFERRED EMBODIMENTS OF THE INVENTION

Figure 1:
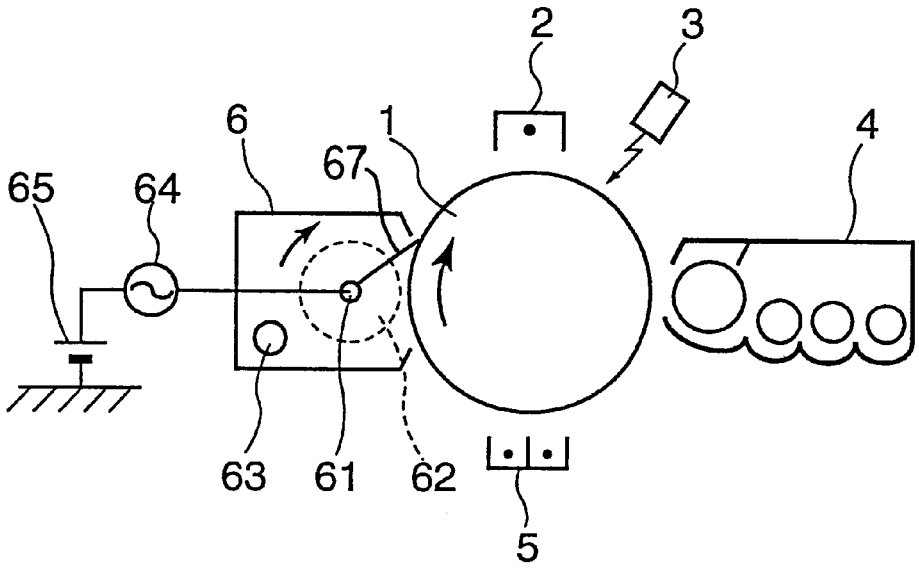
FIG. 1 is a construction diagram showing an essential portion of an image forming apparatus including a cleaning device according to the invention.

As a result of the inventors' devoted study and research on a cleaning device which suppresses the adhesion of toner to the outer surface of a photosensitive element by fusion and the scraping of the photosensitive element while maintaining a satisfactory cleaning performance, they first found out that a cleaning blade which is a direct cause of the adhesion of the toner to the outer surface of the photosensitive element by fusion and the scraping of the photosensitive element can be dispensed with in the electrophotographic process employing the reversed development method. More specifically, the following was found out. In the reversed development method, the toner is moved and attached to an electrostatic latent image portion on the outer surface of the photosensitive element from a developing roller due to a repulsive force created by a potential difference between a development bias potential applied to the developing roller and the surface potential of the electrostatic latent image portion on the outer surface of the photosensitive element. Thus, the electrical attraction between the toner and the photosensitive element is weaker as compared to the normal development method. Therefore, even if the cleaning blade is deleted, a satisfactory cleaning performance can be maintained by suitably selecting the working conditions of the brush. Also in the case that the cleaning blade and the brush are used together, the adhesion of the toner to the outer surface of the photosensitive element by fusion and the scraping of the photosensitive element can be prevented since a pressing force of the cleaning blade against the outer surface of the photosensitive element can be reduced.

As a result of subsequent various studies made on the working conditions of the brush, it was found out that a satisfactory cleaning performance was displayed by applying a DC voltage of 100 to 300 V in absolute value, which has a polarity opposite from the charging polarity of the toner, as a shaft bias to the brush while superimposing an AC voltage having an interpeak voltage of 400 to 700 V at a frequency of 100 to 2,000 Hz thereon. More specifically, a voltage to be applied to the brush is originally sufficient to be a DC voltage having a polarity opposite from the charging polarity of the toner. However, the residual toner on the outer surface of the photosensitive element includes toner particles which were subjected to a transfer voltage having a polarity opposite from the charging polarity of the toner and being applied in a transfer step and came to have the same polarity as the transfer voltage. Thus, the toner particles having the same polarity as the transfer voltage cannot be collected only by applying the DC current. Although how it functions has not yet been known, it was found out that the residual toner on the outer surface of the photosensitive element including the toner particles having the same polarity as the transfer voltage could be satisfactorily collected if a voltage obtained by superimposing the specified AC voltage on the DC voltage is applied to the brush. At this time, the DC voltage applied to the brush needs to have the same polarity as the charging polarity of the toner and lie in the range of 100 to 300 V in absolute value.

TABLE-1 through TABLE-13 show examples in which a frequency of the DC voltage applied to the brush, an electric resistance value between a shaft of the brush and a shaft of the photosensitive element, a brush density are set in different values to change the shaft bias (DC) and the interpeak voltage (AC) to various different values. It should be noted that ○,x in TABLES means: x if a blank portion (non-image forming portion) of a formed image is blackish due to toner thereon, and ○ if an image is satisfactory, being free from the above problem. If cleaning is not satisfactorily performed, the toner not collected from the photosensitive element is transferred to a transfer material after the next image forming operation, with the result that undesired images such as black lines appear in the blank portion (non-image forming portion). Further, if the uncollected toner resides on an image forming portion, the photosensitive element is not charged in this portion during the next image forming operation due to the presence of this toner. Since the image is not developed with a necessary amount of toner, this results in a low image density.

As shown in TABLE-1 through TABLE-7, if the DC voltage applied as the shaft bias is lower than 100 V, the toner residual on the outer surface of the photosensitive element cannot be effectively collected. On the other hand, if this DC voltage is higher than 300 V, this results in a cleaning failure without effectively collecting the toner particles charged at the polarity opposite from that of the DC voltage.

TABLE 1

| Frequency 100[Hz], Electric Resistance Value $10^3$ Ω · cm, Brush Density 30000 Bristles/(inch)$^2$ | | | | | | | |
|---|---|---|---|---|---|---|---|
| | | Interpeak Voltage [V] (AC) | | | | | |
| | | 300 | 400 | 500 | 600 | 700 | 750 |
| Shaft | 50 | x | x | x | x | x | x |
| Bias | 100 | x | ○ | ○ | ○ | ○ | x |
| [V] | 200 | x | ○ | ○ | ○ | ○ | x |
| (DC) | 300 | x | ○ | ○ | ○ | ○ | x |
| | 350 | x | x | x | x | x | x |

TABLE 2

| Frequency 1000[Hz], Electric Resistance Value $10^3$ Ω · cm, Brush Density 70000 Bristles/(inch)$^2$ | | | | | | | |
|---|---|---|---|---|---|---|---|
| | | Interpeak Voltage [V] (AC) | | | | | |
| | | 300 | 400 | 500 | 600 | 700 | 750 |
| Shaft | 50 | x | x | x | x | x | x |
| Bias | 100 | x | ○ | ○ | ○ | ○ | x |
| [V] | 200 | x | ○ | ○ | ○ | ○ | x |
| (DC) | 300 | x | ○ | ○ | ○ | ○ | x |
| | 350 | x | x | x | x | x | x |

TABLE 3

| Frequency 1000[Hz], Electric Resistance Value $10^5$ Ω · cm, Brush Density 70000 Bristles/(inch)$^2$ | | | | | | | |
|---|---|---|---|---|---|---|---|
| | | Interpeak Voltage [V] (AC) | | | | | |
| | | 300 | 400 | 500 | 600 | 700 | 750 |
| Shaft | 50 | x | x | x | x | x | x |
| Bias | 100 | x | ○ | ○ | ○ | ○ | x |
| [V] | 200 | x | ○ | ○ | ○ | ○ | x |
| (DC) | 300 | x | ○ | ○ | ○ | ○ | x |
| | 350 | x | x | x | x | x | x |

TABLE 4

| Frequency 1000[Hz], Electric Resistance Value $10^8$ Ω · cm, Brush Density 70000 Bristles/(inch)$^2$ | | | | | | | |
|---|---|---|---|---|---|---|---|
| | | Interpeak Voltage [V] (AC) | | | | | |
| | | 300 | 400 | 500 | 600 | 700 | 750 |
| Shaft | 50 | x | x | x | x | x | x |
| Bias | 100 | x | ○ | ○ | ○ | ○ | x |
| [V] | 200 | x | ○ | ○ | ○ | ○ | x |
| (DC) | 300 | x | ○ | ○ | ○ | ○ | x |
| | 350 | x | x | x | x | x | x |

TABLE 5

| Frequency 1000[Hz], Electric Resistance Value $10^5$ Ω · cm, Brush Density 30000 Bristles/(inch)$^2$ | | | | | | | |
|---|---|---|---|---|---|---|---|
| | | Interpeak Voltage [V] (AC) | | | | | |
| | | 300 | 400 | 500 | 600 | 700 | 750 |
| Shaft | 50 | x | x | x | x | x | x |
| Bias | 100 | x | ○ | ○ | ○ | ○ | x |
| [V] | 200 | x | ○ | ○ | ○ | ○ | x |

TABLE 5-continued

| Frequency 1000[Hz], Electric Resistance Value $10^5$ Ω · cm, Brush Density 30000 Bristles/(inch)$^2$ | | | | | | | |
|---|---|---|---|---|---|---|---|
| | | Interpeak Voltage [V] (AC) | | | | | |
| | | 300 | 400 | 500 | 600 | 700 | 750 |
| (DC) | 300 | x | ○ | ○ | ○ | ○ | x |
| | 350 | x | x | x | x | x | x |

TABLE 6

| Frequency 1000[Hz], Electric Resistance Value $10^5$ Ω · cm, Brush Density 100000 Bristles/(inch)$^2$ | | | | | | | |
|---|---|---|---|---|---|---|---|
| | | Interpeak Voltage [V] (AC) | | | | | |
| | | 300 | 400 | 500 | 600 | 700 | 750 |
| Shaft | 50 | x | x | x | x | x | x |
| Bias | 100 | x | ○ | ○ | ○ | ○ | x |
| [V] | 200 | x | ○ | ○ | ○ | ○ | x |
| (DC) | 300 | x | ○ | ○ | ○ | ○ | x |
| | 350 | x | x | x | x | x | x |

TABLE 7

| Frequency 2000[Hz], Electric Resistance Value $10^8$ Ω · cm, Brush Density 100000 Bristles/(inch)$^2$ | | | | | | | |
|---|---|---|---|---|---|---|---|
| | | Interpeak Voltage [V] (AC) | | | | | |
| | | 300 | 400 | 500 | 600 | 700 | 750 |
| Shaft | 50 | x | x | x | x | x | x |
| Bias | 100 | x | ○ | ○ | ○ | ○ | x |
| [V] | 200 | x | ○ | ○ | ○ | ○ | x |
| (DC) | 300 | x | ○ | ○ | ○ | ○ | x |
| | 350 | x | x | x | x | x | x |

The AC voltage to be applied needs to have a frequency in the range of 100 to 2,000 Hz and an interpeak voltage in the range of 400 to 700 V.

This is because, if the frequency of the AC voltage is lower than 100 Hz as shown in TABLE-8, an image non-uniformity corresponding to the frequency occurs to thereby cause an imaging failure.

TABLE 8

| Frequency 50[Hz], Electric Resistance Value $10^5$ Ω · cm, Brush Density 70000 Bristles/(inch)$^2$ | | | | | | | |
|---|---|---|---|---|---|---|---|
| | | Interpeak Voltage [V] (AC) | | | | | |
| | | 300 | 400 | 500 | 600 | 700 | 750 |
| Shaft | 50 | x | x | x | x | x | x |
| Bias | 100 | x | x | x | x | x | x |
| [V] | 200 | x | x | x | x | x | x |
| (DC) | 300 | x | x | x | x | x | x |
| | 350 | x | x | x | x | x | x |

If the frequency of the AC voltage is higher than 2000 Hz as shown in TABLE-9, the residual toner cannot be effectively collected, thereby causing an imaging failure.

TABLE 9

| Frequency 2500[Hz], Electric Resistance Value $10^5$ Ω · cm, Brush Density 70000 Bristles/(inch)$^2$ | | | | | | | |
|---|---|---|---|---|---|---|---|
| | | Interpeak Voltage [V] (AC) | | | | | |
| | | 300 | 400 | 500 | 600 | 700 | 750 |
| Shaft | 50 | x | x | x | x | x | x |
| Bias | 100 | x | x | x | x | x | x |
| [V] | 200 | x | x | x | x | x | x |
| (DC) | 300 | x | x | x | x | x | x |
| | 350 | x | x | x | x | x | x |

On the other hand, as shown in TABLE-1 through TABLE-9, the toner particles having a polarity opposite from that of the voltage cannot be effectively collected if the interpeak voltage of the AC voltage is lower than 400 V, whereas fogging occurs if it is higher than 700 V. At this time, the electric resistance value between the shaft the brush and the shaft of the photosensitive element and the brush density need to be in the range of $10^3$ to $10^8$ Ω·cm and in the range of 30000 to 100000 Bristlesl(inch)$^2$, respectively.

This is because of the following reasons. If the electric resistance value is lower than $10^3$ Ω·cm as shown in TABLE-10, electric discharge is likely to occur to the photosensitive element and damage the photosensitive layer thereof, thereby causing an imaging failure.

TABLE 10

| Frequency 1000[Hz], Electric Resistance Value $10^2$ Ω · cm, Brush Density 70000 Bristles/(inch)$^2$ | | | | | | | |
|---|---|---|---|---|---|---|---|
| | | Interpeak Voltage [V] (AC) | | | | | |
| | | 300 | 400 | 500 | 600 | 700 | 750 |
| Shaft | 50 | x | x | x | x | x | x |
| Bias | 100 | x | x | x | x | x | x |
| [V] | 200 | x | x | x | x | x | x |
| (DC) | 300 | x | x | x | x | x | x |
| | 350 | x | x | x | x | x | x |

On the other hand, if the electric resistance value is higher than $10^8$ Ω·cm as shown in TABLE-11, a sufficient cleaning performance cannot be obtained due to a drop of the applied voltage, thereby causing an imaging failure.

TABLE 11

| Frequency 1000[Hz], Electric Resistance Value $10^9$ Ω · cm, Brush Density 70000 Bristles/(inch)$^2$ | | | | | | | |
|---|---|---|---|---|---|---|---|
| | | Interpeak Voltage [V] (AC) | | | | | |
| | | 300 | 400 | 500 | 600 | 700 | 750 |
| Shaft | 50 | x | x | x | x | x | x |
| Bias | 100 | x | x | x | x | x | x |
| [V] | 200 | x | x | x | x | x | x |
| (DC) | 300 | x | x | x | x | x | x |
| | 350 | x | x | x | x | x | x |

Further, by setting the brush density as high as 30000 to 100000 bristles/(inch)2, the brush can contact the residual toner with an increased frequency to thereby improve the cleaning performance. Furthermore, the interference of the neighboring fibers prevents the bending of the fibers.

If the brush density is lower than 30000 bristles/(inch)$^2$ as shown in TABLE-12, a satisfactory cleaning effect cannot be obtained due to an insufficient number of bristles held in contact with the photosensitive element, thereby causing an imaging failure.

TABLE 12

| Frequency 1000[Hz], Electric Resistance Value $10^5$ Ω · cm, Brush Density 25000 Bristles/(inch)$^2$ | | | | | | | |
|---|---|---|---|---|---|---|---|
| | | Interpeak Voltage [V] (AC) | | | | | |
| | | 300 | 400 | 500 | 600 | 700 | 750 |
| Shaft | 50 | x | x | x | x | x | x |
| Bias | 100 | x | x | x | x | x | x |
| [V] | 200 | x | x | x | x | x | x |
| (DC) | 300 | x | x | x | x | x | x |
| | 350 | x | x | x | x | x | x |

If the brush density is higher than 100000 brisltes/(inch)$^2$ as shown in TABLE-13, an excessive number of bristles are held in contact with the photosensitive element and the brush cannot rotate due to a high frictional force. Further, with an excessive number of bristles, there is not enough space left in the brush to hold the collected toner particles. Accordingly, a satisfactory cleaning effect cannot be obtained due to an inability to completely collect the toner from the photosensitive element, thereby causing an imaging failure.

TABLE 13

| Frequency 1000[Hz], Electric Resistance Value $10^5$ Ω · cm, Brush density 110000/inch)$^2$ | | | | | | | |
|---|---|---|---|---|---|---|---|
| | | Interpeak Voltage [V] (AC) | | | | | |
| | | 300 | 400 | 500 | 600 | 700 | 750 |
| Shaft | 50 | x | x | x | x | x | x |
| Bias | 100 | x | x | x | x | x | x |
| [V] | 200 | x | x | x | x | x | x |
| (DC) | 300 | x | x | x | x | x | x |
| | 350 | x | x | x | x | x | x |

The biting degree of the brush into the photosensitive element is preferably in the range of 0.9 to 1.9 mm. If the biting degree is smaller than 0.9 mm, the contact frequency of the brush with the residual toner decreases although the durability thereof is improved, with the result that the cleaning performance may be reduced. On the other hand, if the biting degree is larger than 1.9 mm, a torque of the brush increases although the contact frequency thereof with the residual toner increases. The increased torque causes the bending of the bristles, thereby reducing the durability of the brush.

Figure 3:
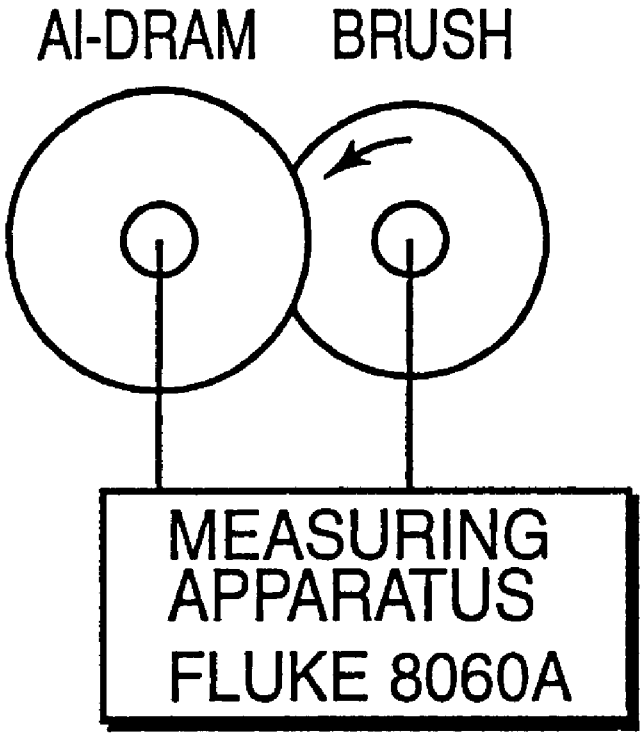
FIG. 3 is a construction diagram of a measuring apparatus for measuring the electric resistance value between the shaft of the brush and the shaft of the photosensitive element.

The electric resistance value of the brush is a value of an electric resistance measured 5 minutes after the start of the rotation of the brush using an electric resistance value measuring apparatus shown in FIG. 3 under the conditions: a brush rotating speed of 100 mm/s and a biting degree of 1±0.2 mm. The biting degree of the brush is a value of a depth of the brush biting into the photosensitive element. For example, if a brush having a cylindrical outer configuration is used to clean a photosensitive drum, the biting degree is a value obtained by subtracting a distance between the center of the brush and that of the photosensitive drum from a sum of the radius of the brush and that of the photosensitive drum.

In the present invention, it is also essential to rotate the brush in a direction opposite from the rotating direction of the photosensitive element in its contact portion with the photosensitive element. Such a construction enables the brush to be securely brought into contact with the residual toner on the outer surface of the photosensitive element, thereby improving the cleaning performance.

Hereinafter, one embodiment of an image forming apparatus using the inventive cleaning device is described with reference to FIG. 1.

In this image forming apparatus, a charging device 2, an exposing device 3, a developing device 4, a transfer device 5 and a cleaning device 6 are arranged around a photosensitive element 1 from an upstream side with respect to the rotating direction of the photosensitive element 1. The charging device 2 charges the photosensitive element 1 to a uniform potential. The exposing device 3 forms an electrostatic latent image on the outer surface of the photosensitive element 1 by exposing the photosensitive element 1 to radiation. The developing device 4 develops the latent image into a toner image by the reversed development method. The transfer device 5 transfers the toner image onto an unillustrated transfer material. The cleaning device 6 removes the toner residual on the photosensitive element 1 after the image transfer.

Figure 2:
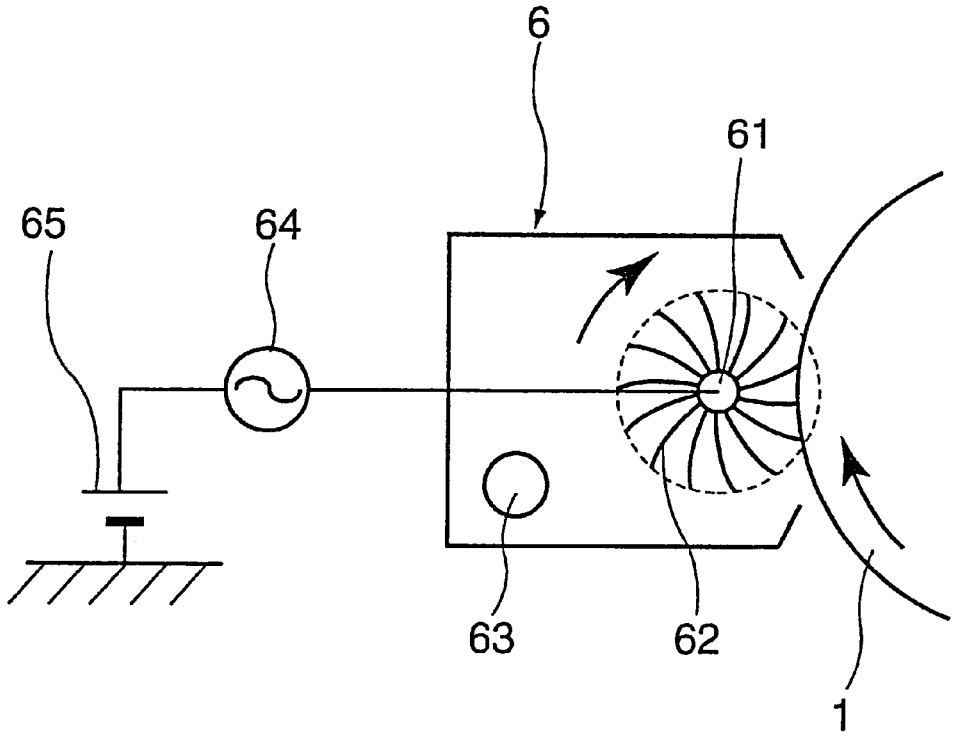
FIG. 2 is a construction diagram showing an essential portion of the cleaning device.

The cleaning device of the invention is described with reference to FIG. 2 showing the construction of an essential portion thereof.

The cleaning device 6 according to the invention is comprised of a brush 62 which is disposed in contact with the photosensitive element 1, a conveyance spiral 63 for conveying the residual toner removably collected from the outer surface of the photosensitive element 1 by the brush 62 to the outside, a blade 67 and an ac power supply 64 and a DC power supply 65 for applying a DC current to the brush 62 via a drive shaft 61 while superimposing an AC current thereon.

By the electrical attraction created by applying a voltage obtained by superimposing the AC current on the DC current to the brush 62 and a physical force created by the rotating contact of the brush 62 with the photosensitive element 1, the residual toner on the outer surface of the photosensitive element 1 is removed from the outer surface of the photosensitive element 1 and collected into the cleaning device 6. The collected residual toner is conveyed to a collection box (not shown) by the rotation of the conveyance spiral 63.

The brush 62 used in the present invention may be an electrically conductive brush. As the bristles of the electrically conductive brush, fibers made of an electrically conductive organic or inorganic material can be used. The thickness and length of the fibers are preferably in the range of 3 to 6 deniers and in the range of 2 to 7 mm, respectively. Further, it is preferable to round the leading ends (portions to be held in sliding contact with the outer surface of the photosensitive element 1) of the bristles of the brush 62 in order to suppress the scraping of the photosensitive element 1.

As the fibers made of the electrically conductive organic material, synthetic or regenerated fibers in which electrically conductive particles are dispersed. For example, polyamide fibers such as nylon 6 and nylon 6—6, polyester fibers such as polyethylene terephthalate, acrylic fibers, polyvinyl alcohol fibers, polyvinyl chloride fibers, rayon, acetate and the like can be used. In order to provide the fibers with electrical conductivity, the fibers may be mixed with an electrically conductive agent or have a metal finishing applied to their outer surfaces. As the fibers made of the electrically conductive inorganic material, carbon fibers may be preferably used. Alternatively, metallic fibers made of, e.g. stainless steel or brass may be used.

The peripheral speed of the brush 62 is not particularly specified. For example, it may be set at 1 to 3 times, preferably 1.5 to 2.5 times the peripheral speed of the photosensitive element 1 in relative speed by rotating in the direction opposite from that of the photosensitive element 1.

The inventive cleaning device is applicable to clean the photosensitive element in various electrophotographic methods of an image forming apparatus such as a copier, a facsimile or a laser printer. Further, the photosensitive elements to be used in combination with the inventive cleaning device are not particularly limited. For example, α-silicone photosensitive elements, selenium photosensitive elements, single-layer or multi-layer organic photosensitive elements or like known photosensitive elements can be used as such.

Although only the brush is used in the foregoing embodiment without using a cleaning blade, they may be used in combination. In such a case as well, the adhesion of the toner to the outer surface of the photosensitive element by fusion and the scraping of the photosensitive element can be prevented since a pressing force of the cleaning blade against the outer surface of the photosensitive element can be reduced.

EXAMPLE 1

After the cleaning device shown in FIG. 2 was mounted in a copier ("Crearge7325" remodel manufactured by Mita Industrial Co., Ltd), charging, exposure, development and fixing were carried out. A satisfactory cleaning performance was displayed, and no adhesion of the toner to the outer surface of the photosensitive element by fusion and no scraping of the photosensitive element were found. The respective parts and working conditions of the cleaning device are as follows.

(Brush)
Material: electrically conductive polyester
Resistance: $10^8$ Ωcm
Density: 60000 bristles/(inch)$^2$
(Cleaning Conditions)
Applied DC voltage: −200 V
Frequency of the applied AC voltage: 1000 Hz
Applied AC voltage: 500 V
Peripheral (surface) speed of the brush: 100 mm/s
Peripheral (surface) speed of the photosensitive element: 127 mm/s
Mote: A difference in the peripheral speed in the above case is 227 mm/s which is a sum of the peripheral speed of the brush and that of the photosensitive element since the brush and the photosensitive element are rotated in opposite directions.)

As described above, according to the invention, in the cleaning device for removing toner residual on the outer surface of the photosensitive element after the electrostatic latent image on the outer surface of the photosensitive element is developed with toner into the toner image by the reversed development method and the toner image is transferred to the transfer material, a brush is provided in contact with the outer surface of the photosensitive element to remove the residual toner, wherein the resistance value between the shaft of the brush and the shaft of the photosensitive element is in the range of $10^3$ to $10^8$ Ωcm; the density thereof is in the range of 30,000 to 100,000 bristlesl (inch)$^2$; a DC voltage having a polarity opposite from the charging polarity of the toner and being in the range of 100 to 300 V in absolute value is applied to the brush after an AC voltage having a frequency of 100 to 2000 Hz and an interpeak voltage of 400 to 700 V is superimposed thereon; and the brush is rotated in a direction opposite from the rotating direction of the photosensitive element in its portion held in contact with the photosensitive element.

Accordingly, the toner residual on the outer surface of the photosensitive element is removed by the rotation of the brush, and the adhesion of the toner to the outer surface of the photosensitive element by fusion and the scraping of the photosensitive element can be suppressed while a satisfactory cleaning performance is maintained.

Further, since the biting degree of the brush into the photosensitive element is set in the range of 0.9 to 1.9 mm, a satisfactory cleaning performance can be maintained and the durability of the brush can be improved.

Furthermore, since the leading ends of bristles of the brush are rounded, the scraping of the photosensitive element can be suppressed.

Although the present invention has been fully described by way of examples with reference to the accompanying drawings, it is understood that various changes and modifications will be apparent to those skilled in the art. Therefore, unless otherwise such changes and modifications depart from the scope of this invention as defined in the following section, they should be construed as being included therein.

What is claimed is:

1. A cleaning device for removing residual toner in an imaging apparatus using toner to produce a toner image, comprising:

a photosensitive element having an outer surface and a shaft defining an axis of rotation;

a brush held in contact with the outer surface of the photosensitive element to remove the residual toner, said brush having a shaft defining an axis of rotation, the shaft of the brush and the shaft of the photosensitive element defining a resistance therebetween;

a voltage source for applying a DC voltage, having a polarity opposite from a charging polarity of the toner and being in the range of 100 to 300 V in absolute value, to the brush and across the resistance, and for applying an AC voltage, having a frequency of 100 to 2000 Hz and an interpeak voltage of 400 to 700 V, to the brush and across the resistance; and a rotation device for rotating the brush in a direction opposite from the rotating direction of the photosensitive element, wherein:

the resistance value between of the shaft of the brush and the shaft of the photosensitive element is in the range of $10^3$ to $10^8$ Ωcm, the brush has a density in the range of 30,000 to 100,000 bristles/(inch)$^2$, and said DC voltage and said AC voltage are superimposed.

2. The cleaning device according to claim 1, further comprising at least one bite being formed where the brush contacts the photosensitive element, wherein the at least one bite of the brush into the photosensitive element is in the range of 0.9 to 1.9 mm.

3. The cleaning device according to claim 1, wherein said brush has bristles with a plurality of leading ends which are rounded.

4. A cleaning device for removing residual toner in an imaging apparatus using toner to produce a toner image, comprising:

a photosensitive element having a shaft defining an axis of rotation;

a rotating device rotating a rotatable member in a direction opposite from the rotating direction of the photosensitive element;

a brush having a shaft defining an axis of rotation which is mounted on an outer circumferential surface of the rotatable member and brought into contact with an outer surface of the photosensitive element to remove the residual toner, a resistance value between the shaft of the brush and the shaft of the photosensitive element being in the range of $10^3$ to $10^8$ Ωcm, and the brush having a density in the range of 30,000 to 100,000 bristles/(inch)$^2$; and a voltage source for applying a voltage having a polarity opposite from a charging polarity of the toner and applying a DC voltage, of 100 to 300 V in absolute value, to the brush and across the resistance and applying an AC voltage, having a frequency of 100 to 2000 Hz and an interpeak voltage of 400 to 700 V, to the brush and across the resistance, wherein said AC voltage is applied before said DC voltage.

5. The cleaning device according to claim 4, wherein the brush contacts the photosensitive element to form at least one bite such that the at least one bite of ther brush into the photosensitive element is in the range of 0.9 to 1.9.

6. The cleaning device according to claim 4, wherein said brush has bristles with a plurality of leading enda which are are rounded.

7. The cleaning device according to claim 4, wherein said rotatable device rotates the rotates member at a speed such that a peripheral speed of the brush is 1 to 3 times a peripheral speed of the photosensitive element.

8. The cleaning device according to claim 7, wherein said rotatable device rotates rotatable member at a speed such that a peripheral speed of the brush is 1.5 to 2.0 times the peripheral speed of the photosensitive element.

9. The cleaning device according to claim 7, further comprising a cleaning blade provided in contact with the outer surface of the photosensitive element.

* * * * *